US006672923B1

(12) United States Patent
Ohkawai et al.

(10) Patent No.: US 6,672,923 B1
(45) Date of Patent: Jan. 6, 2004

(54) METHOD OF MANUFACTURING ARC TUBE

(75) Inventors: Nobuo Ohkawai, Shizuoka (JP); Yoshitaka Ohshima, Shizuoka (JP); Akihiro Nagata, Shizuoka (JP); Shinichi Irisawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 598 days.

(21) Appl. No.: 09/612,269

(22) Filed: Jul. 7, 2000

(30) Foreign Application Priority Data

Jul. 7, 1999 (JP) ..... P 11-193007

(51) Int. Cl.[7] ..... H01J 27/08
(52) U.S. Cl. ..... 445/26; 445/27
(58) Field of Search ..... 445/26, 39, 42, 445/22, 27, 43, 66, 71; 313/578, 579, 580, 623, 624

(56) References Cited

U.S. PATENT DOCUMENTS 3,685,880 A * 8/1972 Sobleski
3,910,662 A * 10/1975 Fujio et al.
5,133,682 A * 7/1992 Gilligan et al.
5,138,227 A * 8/1992 Heider et al.
5,877,590 A * 3/1999 Fukujo et al.
5,936,349 A 8/1999 Fukai et al. ..... 313/623
5,984,749 A * 11/1999 Nishibori et al.
6,132,279 A * 10/2000 Horiuchi et al.
6,306,002 B1 * 10/2001 Kaneko et al.

* cited by examiner

*Primary Examiner*—Sandra O'Shea
*Assistant Examiner*—Dalei Dong
(74) *Attorney, Agent, or Firm*—Sughrue Mion, PLLC

(57) ABSTRACT

A method of manufacturing an arc tube having a light emitting tube portion, a first pinch seal portion, and a second pinch seal portion, all formed on a quartz glass tube. The first and second pinch seal portions are disposed on both sides of the light emitting tube portion. The quartz glass is provided almost vertically with the first pinch seal portion down. A thermal insulating plate is provided in a boundary position between the light emitting tube portion and a portion to be pinch-sealed in an outer peripheral space of the quartz glass tube. Liquid nitrogen is jetted from a cooling nozzle provided obliquely below the light emitting tube portion toward the same, thereby cooling the light emitting tube portion. The portion to be pinch-sealed is heated with a burner, and pinch-sealed with a pincher immediately thereafter.

6 Claims, 6 Drawing Sheets

METHOD OF MANUFACTURING ARC TUBE

BACKGROUND OF THE INVENTION

1. Field of the Invention

The present invention relates to a method of manufacturing an arc tube to be used as a light source such as a headlamp for vehicles.

2. Description of the Related Art

In recent years, an arc tube has often been used as a light source such as a headlamp for vehicles because it can carry out high-intensity irradiation.

As shown in FIG. 5, an arc tube to be used as the headlamp for vehicles generally comprises an arc tube body 114 made of quartz glass in which pinch seal portions 114*b*1 and 114*b*2 are provided on both sides of a light emitting tube portion 114*a* forming a discharge space 112, and a pair of electrode assemblies 116A and 116B pinch-sealed with the pinch seal portions 114*b*1 and 114*b*2 such that tip portions thereof are protruded toward the discharge space 112.

The arc tube is manufactured by forming the light emitting tube portion 114*a* on a quartz glass tube and sequentially forming the pinch seal portions 114*b*1 and 114*b*2 on both sides thereof. At each pinch-sealing step, a portion to be pinch-sealed is pinch-sealed with a pincher immediately after it is heated with a burner. Consequently, the pinch seal portions 114*b*1 and 114*b*2 are formed.

As shown in FIGS. 6A and 6B, it is necessary to fill the discharge space 112 with a liquefied inert gas at a second pinch-sealing step (that is, a step of forming the second pinch seal portion 114*b*2 on a quartz glass tube 114' provided with the light emitting tube portion 114*a* and the first pinch seal portion 114*b*1). Therefore, the light emitting tube portion 114*a* is cooled. As shown in FIG. 6A, the cooling operation has conventionally been carried out by jetting liquid nitrogen from a cooling nozzle 104 provided on the side of the light emitting tube portion 114*a* toward the light emitting tube portion 114*a* in a state in which a thermal insulating plate 102 is provided in a boundary position between the light emitting tube portion 114*a* and the portion 114*b*2' to be pinch-sealed in the outer peripheral space of the quartz glass tube 114' provided almost vertically with the first pinch seal portion 114*b*1 provided in a lower part.

In the conventional manufacturing method, however, the cooling nozzle 104 is provided laterally in the vicinity of the lower part of the thermal insulating plate 102. Therefore, the liquid nitrogen is vaporized in the early stage through heat transfer from the thermal insulating plate 102 and a burner 106. Consequently, the light emitting tube portion 114*a* is cooled insufficiently. Depending on the circumstances, the liquefied inert gas filled in the discharge space 112 is vaporized (expanded), and the light emitting tube portion 114*a* bursts immediately after the pinch-sealing operation using a pincher 108 so that the inert gas leaks as shown in FIG. 6B.

SUMMARY OF THE INVENTION

The present invention has been made in consideration of the above-mentioned circumstances and has an object to provide a method of manufacturing an arc tube which can increase the cooling efficiency of the light emitting tube portion through the jet of the liquid nitrogen, thereby preventing the light emitting tube portion from bursting at the second pinch-sealing step.

The object of the present invention is achieved by devising the arrangement of the cooling nozzle.

The present invention provides a method of manufacturing an arc tube including pinch seal portions on both sides of a light emitting tube portion in which a second pinch seal portion is formed on a quartz glass tube provided with the light emitting tube portion and a first pinch seal portion, the method comprising the steps of:

providing the quartz glass tube almost vertically with the first pinch seal portion positioned in a lower part and providing a thermal insulating plate in a boundary position between the light emitting tube portion and a portion to be pinch-sealed in an outer peripheral space of the quartz glass tube;

jetting liquid nitrogen from a cooling nozzle provided obliquely below the light emitting tube portion toward the light emitting tube portion, thereby cooling the light emitting tube portion in this state, and heating the portion to be pinch-sealed with a burner; and pinch-sealing the portion to be pinch-sealed with a pincher immediately thereafter.

If the "cooling nozzle" is provided obliquely below the light emitting tube portion and serves to jet the liquid nitrogen toward the light emitting tube portion, a specific structure including the number of the cooling nozzles to be provided and a liquid nitrogen jet angle is not restricted particularly.

With the above-mentioned structure, in the method of manufacturing an arc tube according to the present invention, liquid nitrogen is jetted from the cooling nozzle provided obliquely below the light emitting tube portion toward the light emitting tube portion in order to cool the light emitting tube portion at the second pinch-sealing step. Therefore, the cooling nozzle is set somewhat apart from the thermal insulating plate. In that case, moreover, the thermal insulating plate as well as the light emitting tube portion can be cooled through the jet of the liquid nitrogen to be carried out obliquely upward. Consequently, the cooling nozzle is not easily influenced by heat transferred from the thermal insulating plate and the burner. For this reason, the liquid nitrogen jetted from the cooling nozzle is vaporized slowly so that the light emitting tube portion is fully cooled. Accordingly, the liquefied inert gas filled in the discharge space is not vaporized (expanded) for a while after the pinch-sealing operation. Consequently, the light emitting tube portion can be prevented from bursting to leak the inert gas.

According to the present invention, thus, the cooling efficiency of the light emitting tube portion which is obtained through the jet of the liquid nitrogen can be increased at the second pinch-sealing step. Consequently, it is possible to prevent the light emitting tube portion from bursting to leak the inert gas.

In the present invention, furthermore, the liquid nitrogen is jetted obliquely upward. Therefore, the thermal insulating plate as well as the light emitting tube portion can be cooled. Consequently, it is possible to prevent the thermal insulating plate itself from being deteriorated.

According to the present invention, moreover, the burner and the cooling nozzle are positioned sufficiently apart from each other. Therefore, it is possible to prevent the burner from being cooled through the cooling nozzle to reduce a thermal efficiency thereof.

With the above-mentioned structure, if a portion of the thermal insulating plate in the vicinity of the outer periphery of a quartz glass tube is formed like an upward taper, a cooling space formed around the light emitting tube portion can be reduced and the liquid nitrogen can be prevented from being scattered in such a direction as not to contribute to the cooling operation of the light emitting tube portion. Consequently, the cooling efficiency can be enhanced still more.

While the specific structure of the cooling nozzle is not particularly restricted as described above, it is preferable, for the following reasons, that the liquid nitrogen jet angle is set upwardby 10° to 60° with respect to a horizontal plane.

More specifically, the cooling nozzle is heated through heat transfer from the thermal insulating plate at an angle of less than 10° so that the light emitting tube portion is often cooled insufficiently. On the other hand, if the angle exceeds 60°, the liquid nitrogen is jetted upward from a clearance between the thermal insulating plate and the quartz glass tube. Consequently, the heating temperature of the lower end of the portion to be pinch-sealed is dropped so that insufficient melting operation is often carried out. The angle is not set to 10 to 60° but preferably 20° to 50°, and more preferably 30 to 45°.

With the above-mentioned structure, it is preferable, for the following reasons, that the inside diameter of the tip portion of the cooling nozzle should be set to 3 mm or less and the distance between the tip surface of the cooling nozzle and the outer surface of the light emitting tube portion should be set to 40 mm or less.

When the inside diameter of the tip portion of the cooling nozzle exceeds 3 mm, a large amount of liquid nitrogen is thus jetted in an unnecessary direction other than the light emitting tube portion. Consequently, the liquid nitrogen is wasted. In the case in which the inside diameter of the tip portion of the cooling nozzle is set to 3 mm or less and the distance between the tip surface of the cooling nozzle and the outer surface of the light emitting tube portion exceeds 40 mm, a portion of the quartz glass tube against which the liquid nitrogen hits is greatly changed due to a fluctuation in the discharge pressure of a gas cylinder for supplying the liquid nitrogen. Consequently, the light emitting tube portion is often cooled insufficiently.

With the above-mentioned structure, in the case in which the liquid nitrogen is repeatedly jetted through the cooling nozzle in a plurality of stations, it is preferable that the liquid nitrogen jet angle of the cooling nozzle in each of the stations should be set to have an almost equal value in order to cool the light emitting tube portion efficiently.

With the above-mentioned structure, in the case in which heating operation is repeatedly carried out through the burner in a plurality of stations, it is preferable, for the following reasons, that the heating power of the burner in each of the stations should be set to be gradually increased every movement to a new one of the stations.

That is, it is preferable that the heating power of the burner should be maximized immediately before the pinch-sealing operation in order to carry out the pinch-sealing operation reliably. If the heating power is increased from the beginning, the quartz glass tube is unnecessarily melted and the cooling efficiency of the light emitting tube portion is reduced.

DETAILED DESCRIPTION OF THE PREFERRED EMBODIMENTS

A preferred embodiment of the present invention will be described below with reference to the drawings.

Figure 1:
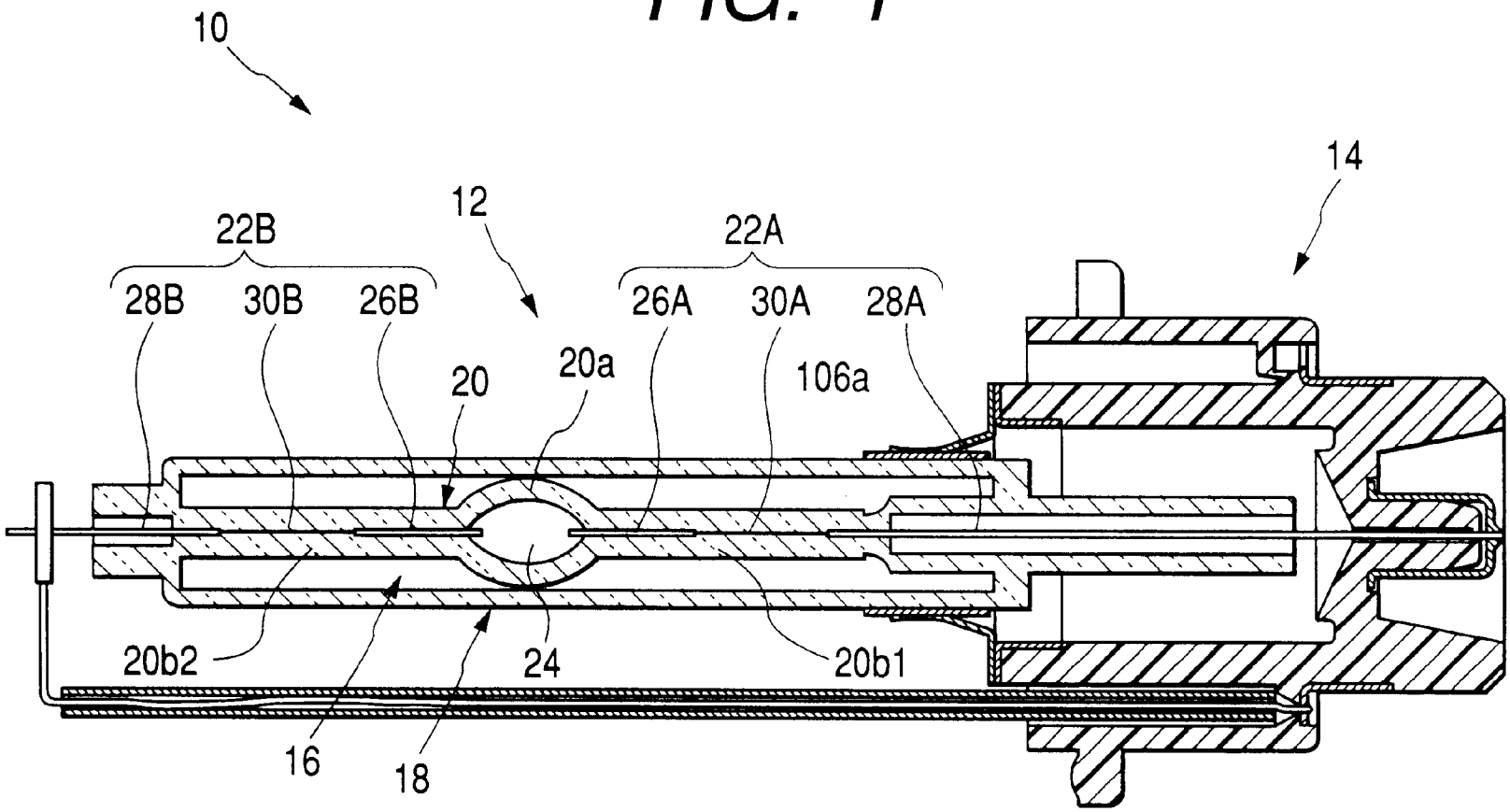
FIG. 1 is a side sectional view showing a discharge valve incorporating an arc tube to be an object of a manufacturing method according to an embodiment of the present invention.

FIG. 1 is a side sectional view showing a discharge valve 10 incorporating an arc tube 16 to be an object of a manufacturing method according to an embodiment of the present invention.

As shown, the discharge valve 10 is a light source valve attached to a headlamp for vehicles and comprises an arc tube unit 12 extended in a longitudinal direction and an insulating plug unit 14 for fixedly supporting the rear end of the arc tube unit 12.

The arc tube unit 12 is provided with an arc tube 16 and a shroud tube 18 surrounding the arc tube 16 which are formed integrally.

The arc tube 16 includes an arc tube body 20 obtained by processing a quartz glass tube, and a pair of longitudinal electrode assemblies 22A and 22B buried in the arc tube body 20.

In the arc tube body 20, an almost elliptical spherical light emitting tube portion 20*a* is formed in the center, and pinch seal portions 20*b*1 and 20*b*2 are formed on both sides longitudinally. An almost elliptical spherical discharge space 24 extended in the longitudinal direction is formed in the light emitting tube portion 20*a,* and is filled with mercury, a xenon gas and a metal halide.

The electrode assemblies 22A and 22B are coupled and fixed to bar-shaped tungsten electrodes 26A and 26B through lead wires 28A and 28B and molybdenum foils 30A and 30B, and are pinch-sealed with the arc tube body 20 in the pinch seal portions 20*b*1 and 20*b*2. In that case, both the molybdenum foils 30A and 30B are buried in the pinch seal portions 20*b*1 and 20*b*2, while the tungsten electrodes 26A and 26B are protruded into the discharge space 24 with the tip portions thereof opposed to each other on the both longitudinal sides.

The arc tube 16 is manufactured by forming the light emitting tube portion 20*a* on the quartz glass tube and sequentially forming the pinch seal portions 20*b*1 and 20*b*2 on both sides thereof.

Figure 2C:
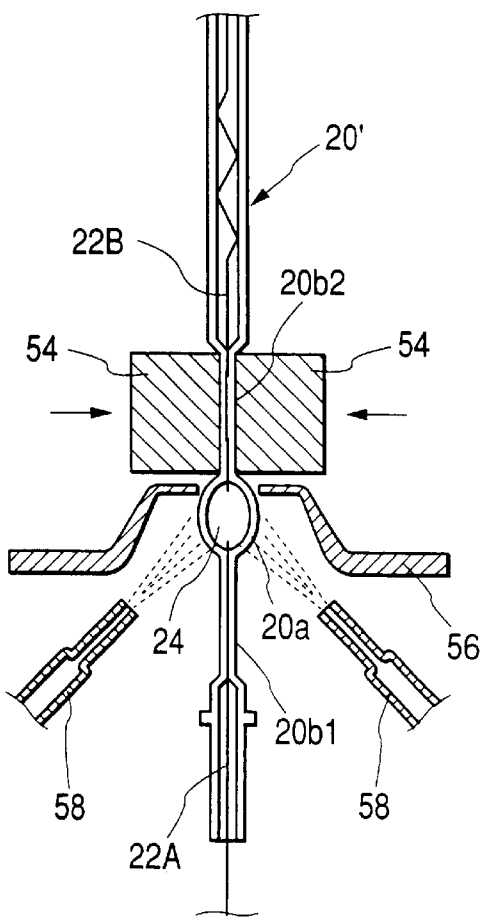
FIGS. 2A to 2C are side sectional views showing a second pinch-sealing step of the manufacturing method.
Figure 2B:
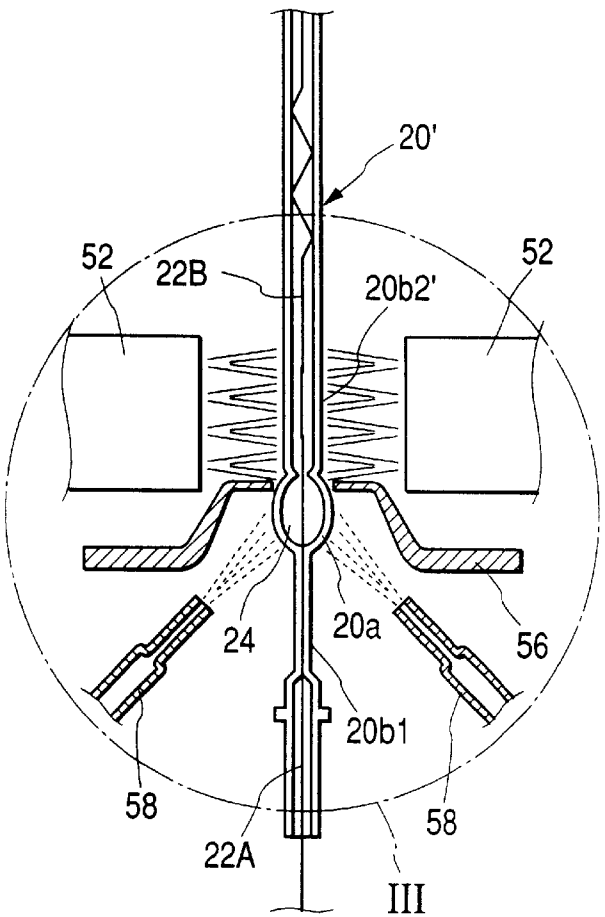
Figure 2A:
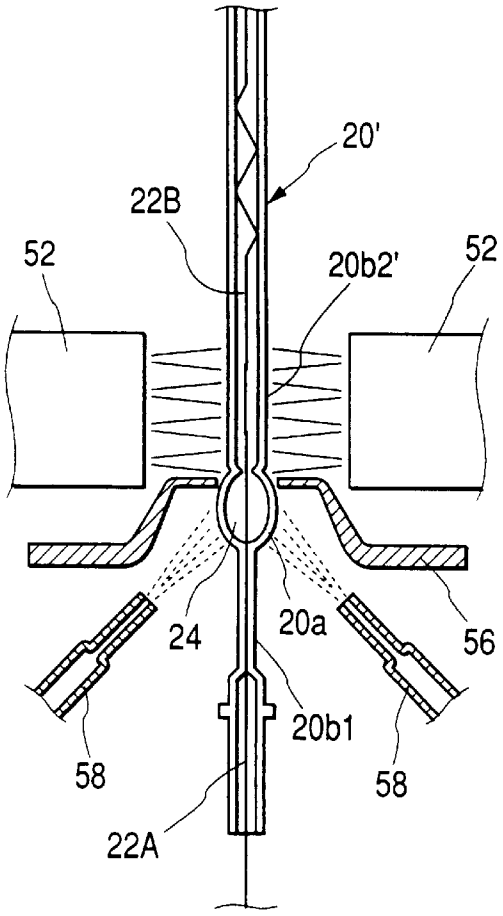
Figure 3:
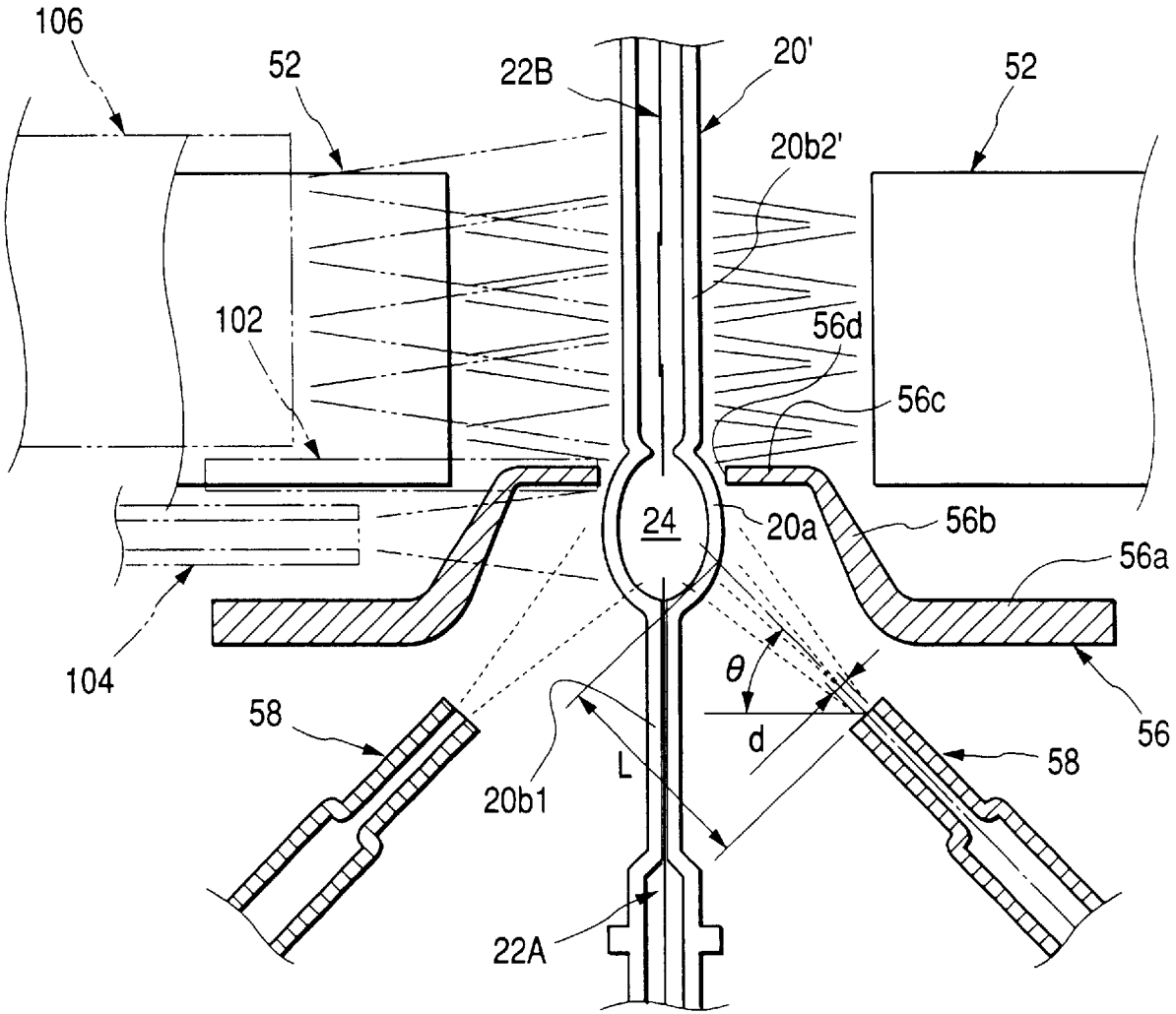
FIG. 3 is an enlarged view showing the portion III in FIG. 2B.
Figure 4:
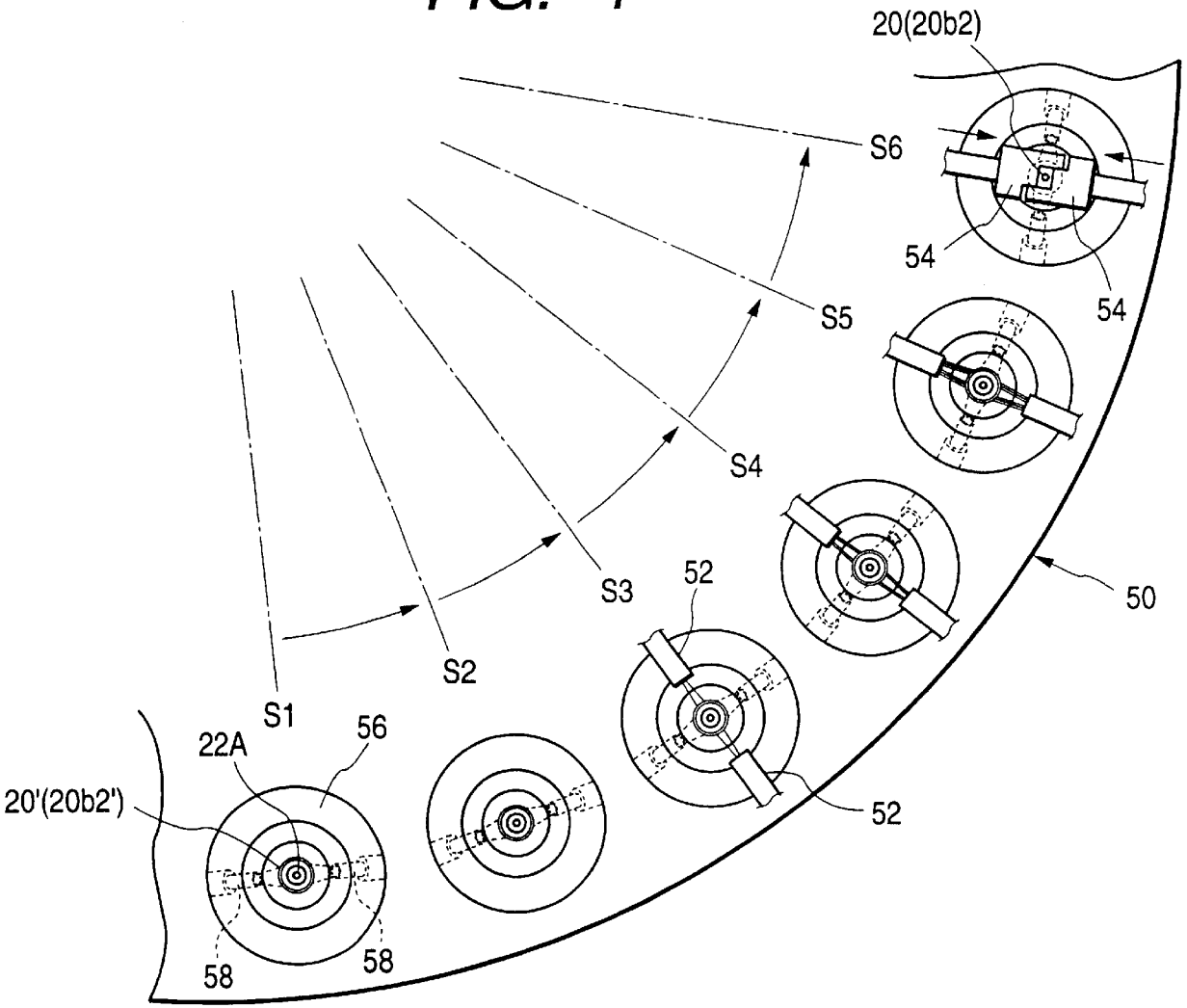
FIG. 4 is a plan view showing an index table on which the second pinch-sealing step is carried out;.
Figure 5:
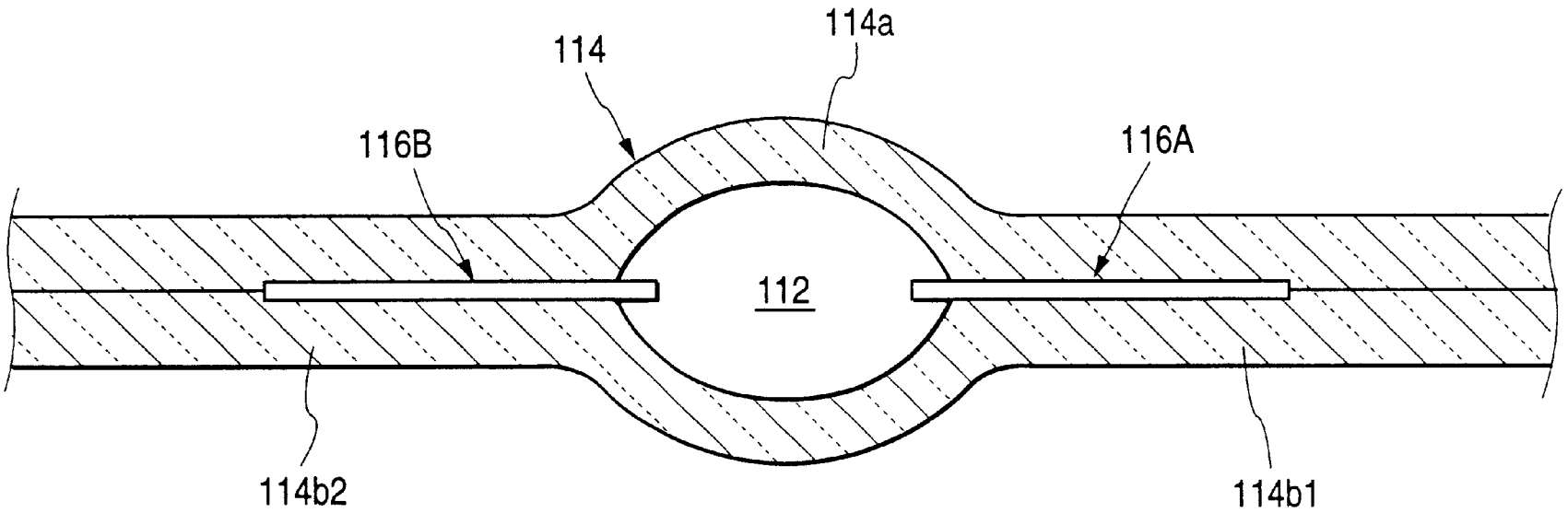
PRIOR ART FIG. 5
FIG. 5 is a sectional view showing a main part, illustrating the general structure of the arc tube.
Figure 6B:
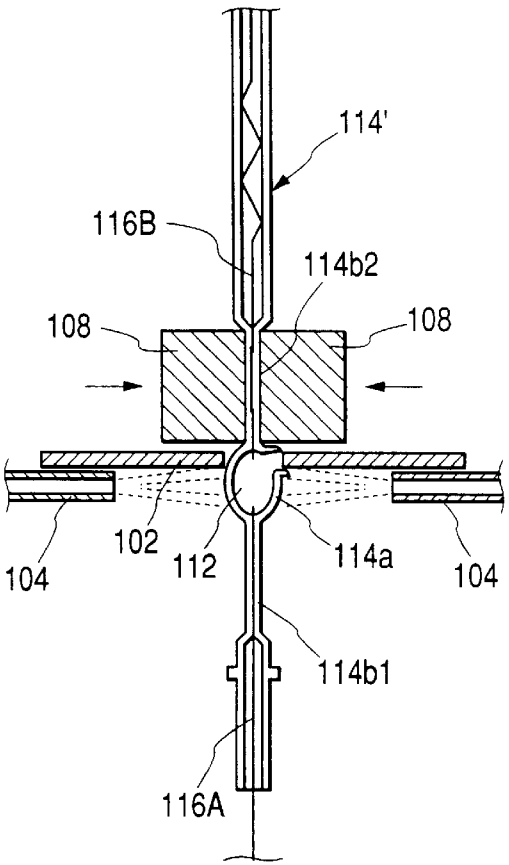
FIG. 6B PRIOR ART
FIGS. 6A and 6B are views similar to FIG. 2, illustrating a conventional example.
Figure 6A:
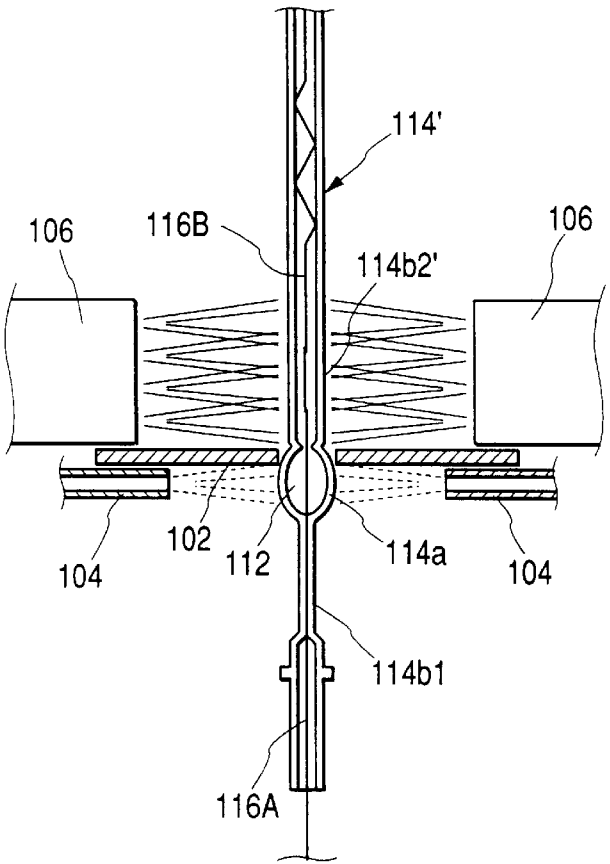
FIG. 6A PRIOR ART

FIGS. 2A to 2C are a side sectional view showing a second pinch-sealing step (that is, a step of forming the second pinch seal portion 20*b*2 on a quartz glass tube 20' provided with the light emitting tube portion 20*a* and the first pinch seal portion 20*b*1), and FIG. 3 is an enlarged view showing a III portion. FIG. 4 is a plan view showing an index table 50 on which the second pinch-sealing step is carried out.

At the second pinch-sealing step, as shown in FIGS. 2A and 2B, a portion 20*b*2' to be pinch-sealed in the quartz glass tube 20' provided almost vertically with the first pinch seal portion 20*b*1 positioned in a lower part is heated through a burner 52 and is pinch-sealed with a pincher 54 immediately thereafter as shown in FIG. 2C so that the pinch seal portion 20*b*2 is formed.

At the second pinch-sealing step, it is necessary to fill the discharge space 24 with a liquefied xenon gas (inert gas). Therefore, the light emitting tube portion 20*a* is cooled. This cooling operation is carried out by jetting liquid nitrogen from a plurality of cooling nozzles 58 toward the light emitting tube portion 20*a* with a thermal insulating plate 56 provided in a boundary position between the light emitting tube portion 20*a* and the portion 20*b*2' to be pinch-sealed in the outer peripheral space of the quartz glass tube 20'.

As shown in FIG. 3 in detail, the thermal insulating plate 56 is formed of an annular member made of stainless steel, and a portion of the thermal insulating plate 56 in the vicinity of the outer periphery of the quartz glass tube 20' is formed like an upward taper. More specifically, the thermal insulating plate 56 includes an outer peripheral plane portion 56*a* formed horizontally, an upward taper portion 56*b* conically rising from the inner peripheral edge of the outer peripheral plane portion 56*a*, and an inner peripheral plane portion 56*c* extended horizontally from the upper end of the upward taper portion 56*b* toward the inner peripheral side and provided with an insertion hole 56*d* for inserting the quartz glass tube 20' in a central part thereof. The outer peripheral plane portion 56*a* is formed comparatively thickly, the upward taper portion 56*b* gradually reduces a thickness from a lower end toward an upper end, and the inner peripheral plane portion 56*c* is formed comparatively thinly.

Each cooling nozzle 58 is provided obliquely below the light emitting tube portion 20*a*, and a liquid nitrogen jet angle θ is set upward by 10 to 60° (for example, approximately 45°) with respect to a horizontal plane. Moreover, an inside diameter d of the tip portion of the cooling nozzle 58 is set to 3 mm or less (for example, approximately 1.5 mm), and a distance L between the tip surface of the cooling nozzle 58 and the outer surface of the light emitting tube portion 20*a* is set to 40 mm or less (for example, approximately 15 mm). Furthermore, a liquid nitrogen discharge pressure of the cooling nozzle 58 is set to 0.3 to 1.5 $kg/m^2$ (for example, approximately 1 $kg/m^2$).

The burner 52 is provided on both sides of the portion 20*b*2' to be pinch-sealed in the quartz glass tube 20', and serves to irradiate a flame toward the portion 20*b*2' to be pinch-sealed. In that case, the burner 52 is provided with a lower end surface thereof positioned below the upper surface of the inner peripheral plane portion 56*c* of the thermal insulating plate 56 such that the flame reliably reaches the lower end of the portion 20*b*2' to be pinch-sealed.

FIG. 3 shows, in a two-dotted chain line, the arrangement (on one of sides) of a thermal insulating plate 102, a cooling nozzle 104 and a burner 106 at a conventional second pinch-sealing step.

As shown in FIG. 4, the operation for jetting liquid nitrogen from the cooling nozzle 58 and the heating operation of the burner 52 are repeatedly carried out in a plurality of stations allocated onto the index table 50.

More specifically, the liquid nitrogen is jetted through the cooling nozzle 58 from a station S1 earlier by several stations than a pinch seal station S6 at which the pinch-sealing operation is carried out to the pinch seal station S6, that is, in the stations S1 to S6. In each of the stations, the arrangement of the cooling nozzle 58 is almost the same, and the liquid nitrogen jet angle of the cooling nozzle 58 and the liquid nitrogen discharge pressure thereof are set to have almost equal values, respectively.

On the other hand, the heating operation of the burner 52 is carried out from the station S3 at which the liquid nitrogen has been started to be jetted to the station S5 immediately before the pinch seal station S6, that is, in the stations S3 to S5. In each of the stations, the arrangement of the burner 52 is almost the same, while the heating power of the burner 52 is set to be gradually increased every movement to a new one of the stations, that is, S3→S4→S5.

Next, the function and effect of the present embodiment will be described.

In the present embodiment, liquid nitrogen is jetted from the cooling nozzle 58 provided obliquely below the light emitting tube portion 20*a* toward the light emitting tube portion 20*a* in order to cool the light emitting tube portion 20*a* at the second pinch-sealing step. Therefore, the cooling nozzle 58 is set somewhat apart from the thermal insulating plate 56. In that case, furthermore, the thermal insulating plate 56 as well as the light emitting tube portion 20*a* can be cooled through the jet of the liquid nitrogen carried out obliquely upward. Consequently, the cooling nozzle 58 is not easily influenced by heat transferred from the thermal insulating plate 56 and the burner 52. For this reason, the liquid nitrogen jetted from the cooling nozzle 58 is vaporized slowly so that the light emitting tube portion 20*a* is fully cooled. Accordingly, the liquefied inert gas filled in the discharge space 24 is not vaporized (expanded) for a while after the pinch-sealing operation. Consequently, the light emitting tube portion 20*a* can be prevented from bursting to leak the inert gas.

In that case, according to the present embodiment, the liquid nitrogen jet angle θ of the cooling nozzle 58 is set upward by 10° to 60° with respect to the horizontal plane. Therefore, the light emitting tube portion 20*a* is not insufficiently cooled, and the cooling nozzle 58 is not so influenced by the heat transferred from the thermal insulating plate 56. In addition, the liquid nitrogen is jetted upward through the cooling nozzle 58 from the clearance between the thermal insulating plate 56 and the quartz glass tube 20', thereby dropping the heating temperature on the lower end of the portion 20*b*2' to be pinch-sealed. Thus, insufficient melting can be prevented.

According to the present embodiment, thus, the cooling efficiency of the light emitting tube portion 20*a* which is obtained through the jet of the liquid nitrogen can be increased at the second pinch-sealing step. Consequently, it is possible to prevent the light emitting tube portion 20*a* from bursting to leak the inert gas.

In the present embodiment, furthermore, the liquid nitrogen is jetted obliquely upward. Therefore, the thermal insulating plate 56 as well as the light emitting tube portion 20*a* can be cooled. Consequently, it is possible to prevent the thermal insulating plate 56 itself from being deteriorated.

According to the present embodiment, moreover, the burner 52 and the cooling nozzle 58 are positioned sufficiently apart from each other. Therefore, it is possible to prevent the burner 52 from being cooled through the cooling nozzle 58 to reduce the thermal efficiency thereof.

In the present embodiment, furthermore, the portion of the thermal insulating plate 56 in the vicinity of the outer periphery of the quartz glass tube 20' is formed like an upward taper. Therefore, the cooling space formed around the light emitting tube portion 20*a* can be reduced to be limited on the inner peripheral side of the upward taper portion 56*b* and the liquid nitrogen can be prevented from being scattered in such a direction as not to contribute to the cooling operation of the light emitting tube portion 20*a* . Consequently, the cooling efficiency can be enhanced still more.

As shown in a two-dotted chain line in FIG. 3, when a burner 106 is provided in such a height as not to interfere with a thermal insulating plate 102 at the conventional second pinch-sealing step, a position in the burner 106 where a flame is irradiated is much higher than the position of the lower end of the portion 20*b*2' to be pinch-sealed. In order to sufficiently heat the portion 20*b*2' to be pinch-sealed down to 25 the lower end thereof, therefore, the expanse of a flame should be utilized. In order to implement this operation, it has been necessary to irradiate a flame with high heating power by positioning the burner 106 apart from the portion 20*b*2' to be pinch-sealed. For this reason, the flame has been irradiated in a direction which is not necessary for heating the portion 20*b*2' to be pinch-sealed. Correspondingly, energy has been wasted. Moreover, such high heating power has caused an increase in the amount of heat transfer to a cooling nozzle 104 through the thermal insulating plate 102. Correspondingly, a cooling efficiency has been reduced.

On the other hand, in the present embodiment, the portion of the thermal insulating plate 56 in the vicinity of the outer periphery of the quartz glass tube 20' is formed like an upward taper. Therefore, the burner 52 can be provided such that a lower end surface thereof is positioned below the upper surface of the inner peripheral plane portion 56*c* of the thermal insulating plate 56 in the outer peripheral side space of the upward taper portion 56*b* of the thermal insulating plate 56. Consequently, it is not necessary to utilize the expanse of the flame differently from the conventional example. Thus, the burner 52 can be provided in proximity to the portion 20*b*2' to be pinch-sealed. Therefore, even if the flame is not irradiated with very high heating power, the portion 20*b*2' to be pinch-sealed can be sufficiently heated down to the lower end thereof. Consequently, it is possible to prevent the energy from being wasted and to enhance the cooling efficiency through the cooling nozzle 58.

In the present embodiment, the inside diameter d of the tip portion of the cooling nozzle 58 is set to 3 mm or less. Therefore, it is possible to prevent a large amount of liquid nitrogen from being jetted in an unnecessary direction other than the light emitting tube portion 20*a* to waste the liquid nitrogen. In addition, the distance between the tip surface of the cooling nozzle 58 and the outer surface of the light emitting tube portion 20*a* is set to 40 mm or less. Consequently, it is possible to prevent the light emitting tube portion 20*a* from being cooled insufficiently due to a great change in the portion of the quartz glass tube 20' against which the liquid nitrogen hits through a fluctuation in the discharge pressure of the gas cylinder for supplying the liquid nitrogen.

In the present embodiment, the liquid nitrogen is repeatedly jetted through the cooling nozzle 58 in a plurality of stations S1 to S6. The liquid nitrogen jet angle of the cooling nozzle 58 in each of the stations S1 to S6 is set to have an almost equal value. Therefore, the light emitting tube portion 20*a* can be cooled efficiently.

In the present embodiment, moreover, the heating operation of the burner 52 is repeatedly carried out in a plurality of stations S3 to S5. The heating power of the burner 52 in each of the stations S3 to S5 is set to be gradually increased every movement to a new one of the stations, that is, S3→S4→S5. Therefore, the heating power of the burner 52 is maximized immediately before the pinch-sealing operation. Consequently, the pinch-sealing operation can be carried out reliably. Furthermore, it is possible to prevent the quartz glass tube 20' from being unnecessarily melted as in the case in which the heating power is increased from the beginning.

In the present embodiment, the arc tube 16 of the discharge valve 10 to be attached to a headlamp for vehicles has been described. For other uses, similarly, the manufacturing method according to the present embodiment can be employed to obtain the same function and effect of the present embodiment.

What is claimed is:

1. A method of manufacturing an arc tube, the arc tube including a light emitting tube portion, a first pinch seal portion, and a second pinch seal portion, wherein the light emitting tube portion, the first pinch seal portion, and the second pinch seal portion are formed on a quartz glass tube, and wherein the first pinch seal portion and the second pinch seal portion are disposed on both sides of the light emitting tube portion, said method comprising the steps of:

providing the quartz glass tube substantially vertically with the first pinch seal portion down;

providing a thermal insulating plate in a boundary position between the light emitting tube portion and a portion to be pinch-sealed in an outer peripheral space of the quartz glass tube;

jetting liquid nitrogen from a cooling nozzle provided obliquely below the light emitting tube portion toward the light emitting tube portion, thereby cooling the light emitting tube portion, and heating the portion to be pinch-sealed with a burner; and pinch-sealing the portion to be pinch-sealed with a pincher immediately thereafter, wherein the thermal insulating plate includes an upward taper at a portion in the vicinity of an outer periphery of the quartz glass tube.

2. The method of manufacturing an arc tube according to claim 1, wherein the thermal insulating plate includes an inner peripheral plane portion facing the quartz glass tube, and wherein the burner is disposed with a lower end surface thereof positioned below an upper surface of the inner peripheral plane portion of the thermal insulating plate.

3. The method of manufacturing an arc tube according to claim 1, wherein a liquid nitrogen jet angle of the cooling nozzle is set upward by 10° to 60° with respect to a horizontal plane.

4. The method of manufacturing an arc tube according to claim 1, wherein an inside diameter of a tip portion of the cooling nozzle is set to 3 mm or less and a distance between a tip surface of the cooling nozzle and an outer surface of the light emitting tube portion is set to 40 mm or less.

5. The method of manufacturing an arc tube according to claim 1, wherein the liquid nitrogen is repeatedly jetted through the cooling nozzle in a plurality of stations and the liquid nitrogen jet angle of the cooling nozzle in each of the stations is set to have the substantially same value.

6. The method of manufacturing an arc tube according to claim 1, wherein the heating operation is repeatedly carried out with the burner in stations and a heating power of the burner in each of the stations is set to be gradually increased every movement to a new one of the stations.

* * * * *